United States Patent [19]

Kardinal et al.

[11] Patent Number: 4,932,798

[45] Date of Patent: Jun. 12, 1990

[54] APPARATUS FOR RECORDING IMAGE INFORMATION ON BOTH SIDES OF RECORDING SHEETS

[75] Inventors: Hans-Joachim Kardinal; Herbert Lehmann, both of Berlin, Fed. Rep. of Germany

[73] Assignee: Siemens Aktiengesellschaft, Berlin and Munich, Fed. Rep. of Germany

[21] Appl. No.: 92,135

[22] Filed: Sep. 2, 1987

[30] Foreign Application Priority Data

Sep. 22, 1986 [DE] Fed. Rep. of Germany ..... 3632517

[51] Int. Cl.[5] ..... B41J 3/20; B65H 29/00

[52] U.S. Cl. ..... 400/120; 271/185; 400/188; 400/624

[58] Field of Search ..... 400/624, 625, 629, 462, 400/120, 121, 124, 126, 188; 271/184, 185, 186

[56] References Cited

U.S. PATENT DOCUMENTS

| | | | |
|---|---|---|---|
| 3,227,444 | 1/1966 | Egan | 271/65 |
| 4,438,915 | 3/1984 | Akamatsu et al. | 400/624 X |
| 4,594,597 | 6/1986 | Liu et al. | 400/625 X |
| 4,595,192 | 6/1986 | Reist | 271/184 |

FOREIGN PATENT DOCUMENTS

| | | | |
|---|---|---|---|
| 2921177 | 12/1979 | Fed. Rep. of Germany . | |
| 56-456 | 5/1981 | Japan | 271/186 |
| 59-115875 | 7/1984 | Japan . | |
| 59-149262 | 8/1984 | Japan . | |
| 134282 | 6/1986 | Japan | 400/624 |
| 248855 | 11/1986 | Japan | 271/186 |
| 21665 | 1/1987 | Japan | 271/184 |
| 21666 | 1/1987 | Japan | 271/184 |

OTHER PUBLICATIONS

"Sheet Flip Enchancer" by Jenkins, *IBM Technical Disclosure Bulletin,* vol. 23, No. 7A, 12/1980, pp. 2635–2636.

Xerox Disclosure Journal, vol. 8, No. 2, Mar./Apr. 1983, p. 101, "Constant Force Spring Inverter".

*Primary Examiner*—Edgar S. Burr
*Assistant Examiner*—Moshe I. Cohen
*Attorney, Agent, or Firm*—Hill, Van Santen, Steadman & Simpson

[57] ABSTRACT

The invention is directed to an apparatus for recording image information on both sides of recording sheets which, lying against a partial circumference of a print roller are conducted past an image recording unit. A format of the inventive apparatus which is particularly simple in structural terms is achieved in that a sheet seating surface approaches the underside of the print roller upon formation of a sheet draw-in gap which lies preceding the image recording unit as seen in the rotational sense of the print roller and in that a sheet guidance surface forming a sheet acceptance gap together with the print roller and following the image recording unit as seen in the rotational sense of the print roller is arranged across the print roller and approaches the sheet seating surface at an acute angle.

6 Claims, 3 Drawing Sheets

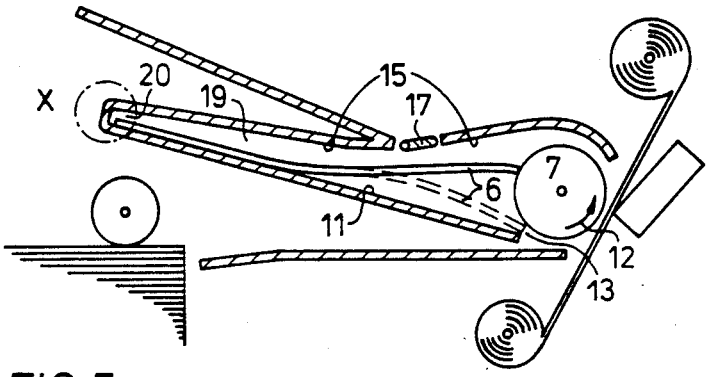
FIG 5
FIG 6
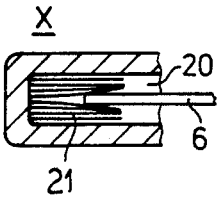
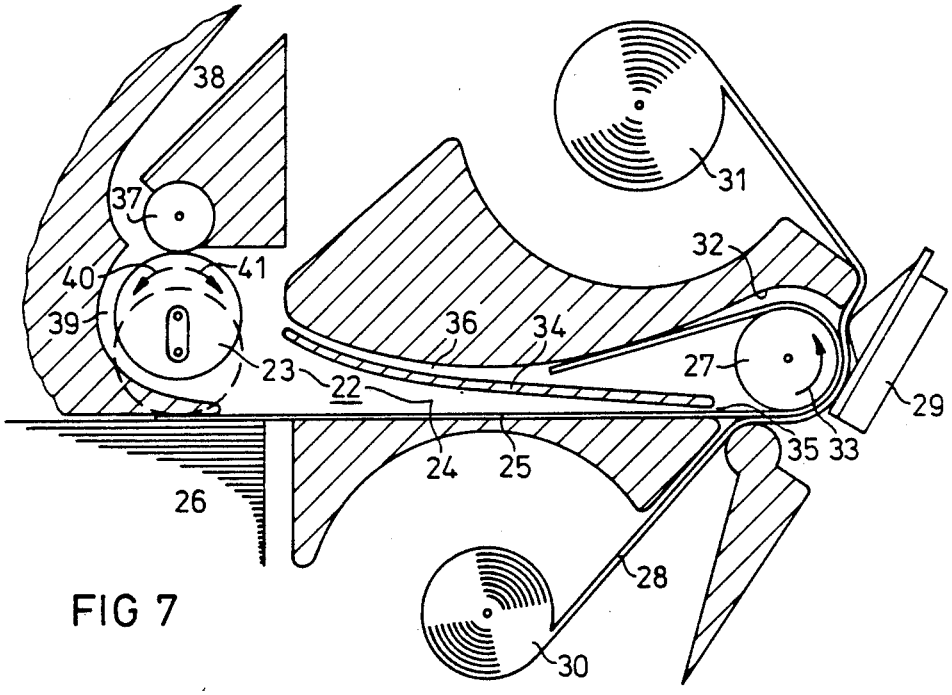
FIG 7

APPARATUS FOR RECORDING IMAGE INFORMATION ON BOTH SIDES OF RECORDING SHEETS

BACKGROUND OF THE INVENTION

1. Field of the Invention

The invention is directed to an apparatus for recording image information on both sides of recording sheets which are conducted past an image recording unit lying against a partial circumference of a print roller.

2. Description of the Prior Art

Such an apparatus disclosed by German published application No. 29 21 177 forms a copier means for two-sided printing of recording sheets which, pressing against a print roller, are conducted past an image recording unit. This is composed of an inked rubber blanket cylinder with whose assistance the recording sheets are printed. For holding a recording sheet against the print roller, the latter comprises a first and a second grab at its roller surface which are arranged offset in circumferential direction of the roller surface at a spacing corresponding to the length of a recording sheet. A recording sheet supplied to the print roller for printing is seized by the first grab at its sheet beginning and is pulled onto the print roller until the sheet end of the recording sheet also lies against the print roller and is seized by the second grab. The turning print roller conducts the recording sheet past the image recording unit where it is printed. For printing the backside of the recording sheet, the first grab releases the sheet beginning of the recording sheet and the second grab holding the sheet end of the recording sheet is pivoted by 180°, so that the recording sheet now has its previously printed side lying against the roller surface. In a further revolution of the print roller, the recording sheet is again conducted past the image recording unit, whereby the backside of the recording sheet is printed this time. A drive means which is arranged in the inside of the print roller is required for the actuation of the two grabs.

SUMMARY OF THE INVENTION

An object of the invention is to provide an apparatus for recording image information on both sides of recording sheets which is constructed in an especially simple structural way and, further, also enables two-sided printing of recording sheets which differ in length.

These objects are inventively achieved in that, in an apparatus of the type initially described, a sheet seating surface is brought against the underside of the print roller upon formation of a sheet draw-in gap lying preceding the image recording unit with respect to the rotational direction of the print roller and in that a sheet guidance surface forming a sheet acceptance gap with the print roller lying behind the image recording unit with respect to the rotational direction of the print roller is arranged above the print roller and approaches the sheet seating surface at an acute angle.

A significant advantage of the apparatus of the invention is that it does not require any movable parts for turning the recording sheets over and, correspondingly, is constructed in an especially simple structural way. The turning of a recording sheet printed on its front side and coming from the print roller is achieved in that the recording sheet is conducted along the sheet guidance surface onto the sheet seating surface, so that the recording sheet having its unprinted backside lying on the sheet seating surface has its sheet end coming last from the print roller proceeding into the region of the sheet draw-in gap in order to be printed on its backside this time.

A further advantage of the apparatus of the invention is that an adaptation of the apparatus to different formats of the recording sheets is not required because the sheet seating surface can accept recording sheets which differ in length.

The sheet seating surface of the apparatus of the invention is preferably inclined in the direction toward the print roller, so that recording sheets which are conducted through the sheet guidance surface onto the seating surface automatically have their sheet end slide into the sheet draw-in gap at the underside of the print roller and are again entrained by the latter.

In a preferred embodiment of the inventive apparatus, the sheet seating surface and the sheet guidance surface form a sheet acceptance channel having a closed channel end at which the sheet seating surface and the sheet guidance surface abut against one another. The shortest distance between the closed channel end and the circumferential surface of the print roller is slightly smaller than the length of a recording sheet. As a result thereof, an especially reliable guidance of the recording sheet is guaranteed because the recording sheet coming from the printer drum has its sheet start strike against the closed channel end and has it slightly compressed in the region between the print roller and the channel end, whereby the sheet end of the recording sheet is supported against the circumference of the print roller and is introduced by the latter into the sheet draw-in gap.

In this context, it is provided in accord with an advantageous improvement of the inventive apparatus that a resilient detent is arranged in the channel end. This, for example, can be fashioned as a member of expanded material or as a brush having hairs directed in the direction toward the print roller. The brush guarantees a gentle holding of even recording sheets differing in length, which, dependent on their length, have their sheet beginning engaging into the brush to a greater or lesser depth.

An outward transfer of the recording sheet out of the channel formed by the sheet seating surface and by the sheet guidance surface after it has been printed on both sides is advantageously achieved in that the sheet guidance surface has a controllable shunt allocated to it for optional delivery of a recording sheet coming from the print roller onto the sheet seating surface or into a sheet discharge channel.

Such a shunt can be eliminated in accord with an advantageous improvement of the inventive apparatus wherein a driveable sheet conveying roller comprising a capstan roller is arranged between that end of the sheet seating surface facing away from the print roller and a sheet discharge channel connecting thereto. A recording sheet coming from the print roller has its sheet beginning proceeding into the region between the sheet conveying roller and the capstan idler and, dependent on the drive direction of the sheet conveying roller, can be again supplied to the print roller for printing the backside or can be forwarded into the sheet discharge channel for removal.

In accord with an advantageous development of the inventive apparatus, supplying recording sheets still unprinted on both sides to the print roller is enabled in that a sheet feeding means is brought up to the print roller under the sheet seating surface and following the sheet draw-in slot with respect to the rotational sense of the print roller and upon formation of a further sheet draw-in slot.

Due to the guidance of the recording sheet, it must be taken into consideration that the backside of the recording sheet is printed "reversed" in comparison to its front side. It is therefore provided in accord with an advantageous improvement of the inventive apparatus that the image recording unit includes recording elements arranged point-by-point in a line and is connected to an output of an electronic page storage means which has a control input for turning the memory content by 180°. When printing the backside of a recording sheet, the page storage means is arranged such over its control input that its entire memory content is rotated by 180°, this corresponding to a mirroring of the printing point information at the two center perpendiculars of the recording sheet; the result thereof is that the backside of the recording sheet is printed in correct reading direction in comparison to its front side.

BRIEF DESCRIPTION OF THE DRAWINGS

FIGS. 1 through 8 shall be referenced below for explaining the inventive apparatus and its function. Shown in detail are:

FIGS. 1 through 4 each show a first exemplary embodiment of the inventive apparatus in a side sectional schematic illustration and in various phases of the image recording process.

FIG. 5 is a further exemplary embodiment of the inventive apparatus.

FIG. 6 is a detail sectional view of the area referenced X in FIG. 5.

FIG. 7 is a preferred exemplary embodiment of the inventive apparatus.

FIG. 8 is a schematic illustration of a control structure for the exemplary embodiments of the inventive apparatus shown in FIGS. 1–7.

DESCRIPTION OF THE PREFERRED EMBODIMENTS

Figure 1:
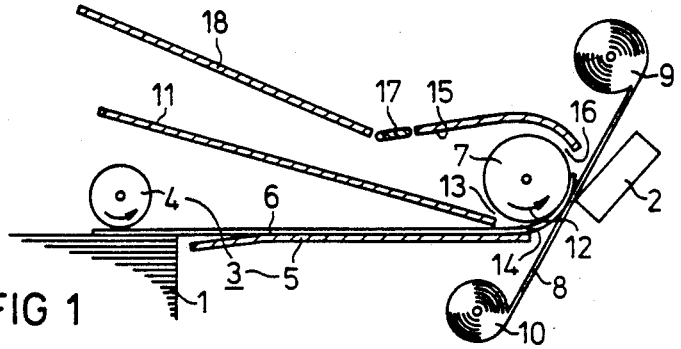

FIGS. 1 through 7 are directed to a thermal-transfer printer as a preferred exemplary embodiment of the inventive apparatus for recording image information on both sides of recording sheets. In a thermal-transfer printer, the image recording ensues in such fashion that the individual recording sheets composed of simple paper are brought into contact with a heat-sensitive color transfer agent and such that pigments contained in the color transfer agent are transferred onto the paper recording sheet in point-by-point fashion on the basis of a likewise point-by-point heating of the color transfer agent. Let it be noted that thermal-transfer printing merely represents an example of many other printing methods which can likewise be utilized in the inventive apparatus.

As FIGS. 1 through 4 show, the individual recording sheets to be printed are arranged in a stack 1. A sheet feeder means 3 is arranged between the stack 1 and an image recording unit 2, this feeder means 3 comprising the essential parts of a sheet feeder roller 4 and of a sheet guiding panel 5 extending from the stack 1 up to the image recording unit 2. The sheet feeder roller 4 conveys an uppermost recording sheet 6 of the stack 1 along the sheet guiding panel 5 into the region of the image recording unit 2.

In the illustrated exemplary embodiment, the image recording unit 2 is composed of a line-like thermal-printing head which extends perpendicular to the plane of the drawing with a length corresponding to the width of the recording sheet 6. In a known way, the thermal-printing head comprises a plurality of heating elements arranged line-like, so that an entire line of picture elements can be simultaneously printed.

A print roller 7 lies opposite the image recording 2 upon interposition of an inked ribbon 8. The inked ribbon is accommodated in an inked ribbon cassette of which only a take-up reel 9 for winding up the inked ribbon 8 and a tape-off reel 10 for unwinding the inked ribbon 8 which lies axially parallel therewith are shown in FIGS. 1 through 4. Between the take-up reel 9 and the take-off reel 10, the inked ribbon together with the recording sheet 6 to be printed are guided between the image recording unit and the print roller 7.

Upon formation of a sheet drawn-in gap 13 lying in front of the image recording unit 2 with reference to a rotational sense 12 of the print roller 7, a sheet seating surface 11 is approached to the underside of the print roller 7. This sheet draw-in gap is arranged in front of a further sheet draw-in gap 14 as seen in the rotational sense 12 of the print roller 7, this further sheet draw-in gap 14 being formed by the sheet guiding panel 5 and by the print roller 7. The sheet seating surface 11 is slanted in the direction toward the print roller 7.

A sheet guidance surface 15 is arranged above the print roller 7 in such fashion that, forming a sheet acceptance gap 16 with the print roller 7 which lies following the image recording unit 2 as seen in the rotational sense 12 of the print roller 7, it approaches the sheet seating surface 11 across the print roller 7 upon formation of an acute angle. A shunt 17 is arranged in the region of the sheet guidance surface 15, this shunt 17 being driveable from a first shunt position shown in FIGS. 1 through 3 for conveying a recording sheet 6 coming from the print roller 7 onto the sheet seating surface 11 into a second shunt position shown in FIG. 4 for forwarding the recording sheet 6 coming from the print roller 7 into a sheet discharge channel 18.

The functioning of the inventive apparatus shall be set forth below with reference to FIGS. 1 through 4.

As FIG. 1 shows, the uppermost recording sheet 6 is conveyed from the stack 1 in the direction toward the print roller 7 with the assistance of the sheet feeder roller 4. The recording sheet 6 has its sheet beginning or forward edge drawn into the further sheet draw-in gap 14 between the sheet guiding panel 5 and the print roller 7 and has it conducted past the image recording unit 2 lying thereagainst. The latter heats the inked ribbon 8 lying thereagainst in accord with the print information (picture information) supplied to it, so that the recording sheet 6 is printed on its front side. During the printing, the recording sheet 6 is continuously forwarded due to the rotation 12 of the print roller 7, whereby the front side of the recording sheet 6 is printed line-by-line.

Figure 2:
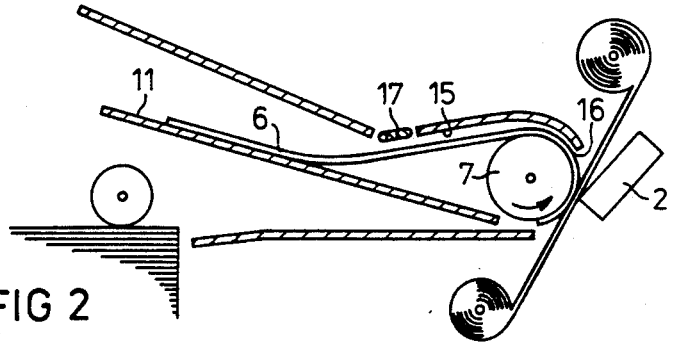
Figure 3:
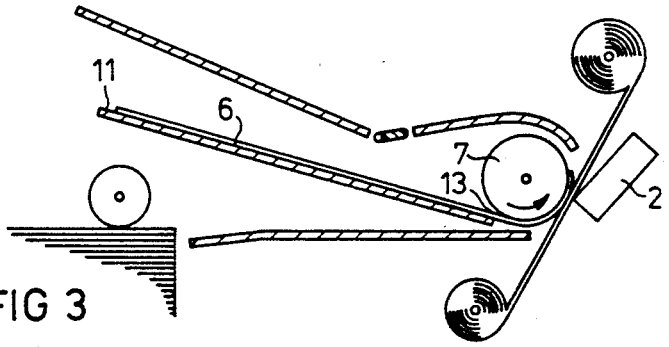

As FIG. 2 shows, the sheet beginning of the recording sheet 6 is conducted through the sheet acceptance gap 16, along the sheet guidance surface 15 and past the shunt 17 onto the sheet seating surface 11. Given continued rotation of the print roller 7, the sheet end or trailing edge of the recording sheet 6 is also conducted past the image recording unit 2 through the sheet acceptance gap 16 until the sheet end of the recording sheet 6 separates from the print roller 7 and falls onto the sheet seating surface 11. As a consequence of the slant of the sheet seating surface 11, the recording sheet 6 slides into the sheet draw-in gap 13 with its sheet end and is seized there by the print roller 7 which now conducts the recording sheet 6 past the image recording unit 2 with its backside (FIG. 3).

Figure 4:
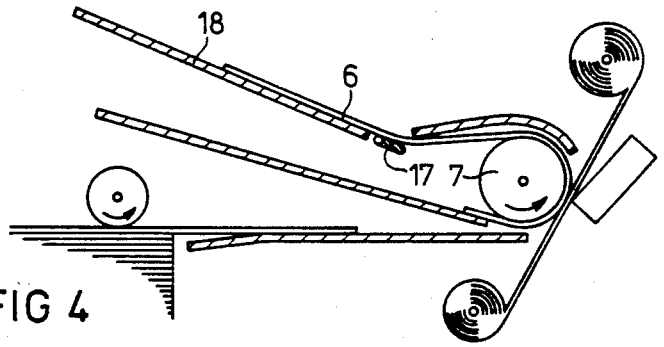

As FIG. 4 shows, the shunt 17 is now driven into a shunt position in which the recording sheet 6 coming from the print roller 7 is deflected into the sheet discharge channel 18 for removal.

FIG. 5 shows a further exemplary embodiment of the inventive apparatus which differs from the exemplary embodiment shown in FIGS. 1 through 4 in that the sheet guidance surface 15 is continued beyond the shunt 17 so that the sheet guidance surface 15 and the sheet seating surface 11 form a sheet acceptance channel 19. The shortest distance between the channel end 20 and the circumference of the print roller 7 is selected such that it is slightly smaller than the length of a recording sheet 6. As FIG. 5 shows, the recording sheet 6 coming from the print roller 7 has its sheet beginning introduced into the sheet acceptance channel 19 and thereby has it sheet beginning strike against the wall of the channel end 20. Given continued rotation of the print roller 7 in the direction 12, the recording sheet 6 has its sheet end supported on the print roller 7 and is thereby slightly compressed. This compression of the recording sheet 6 given further rotation of the print roller 7 effects a snap-over of the recording sheet 6 into the position with broken lines in FIG. 5, whereby the recording sheet 6 has its sheet end introduced into the sheet draw-in gap 13 where it is seized by the rotating print roller 7.

The detail in the region of the channel end 20 referenced X in FIG. 5 is shown magnified in FIG. 6. A resilient detent 21 in the form of a brush having hairs pointing in the direction toward the print roller 7 and also capable of seizing recording sheets 6 differing in length is arranged in the channel end 20.

FIG. 7 shows a further, preferred exemplary embodiment of the inventive apparatus. This apparatus, just like the exemplary embodiment shown in FIG. 1, comprises a sheet feeder means 22 composed of a sheet feeder roller 23 and of a sheet feeder channel 24 for supplying a recording sheet 25 from the stack 26 to a print roller 27. In the region of the print roller 27, the recording sheet 25 is conducted past an image recording unit 29 preferably a line-by-line thermal printing head upon interposition of an inked ribbon 28. The inked ribbon 28 is thereby rolled up onto a take-up reel 31 coming from a take-off reel 30. A sheet guidance surface 32 is arranged above the print roller 27 such that it forms a sheet acceptance gap following the image recording unit 29 as seen in the rotational sense 33 of the print roller 27 and such that it approaches a sheet seating surface 34 at a acute angle from there across the print roller 27. Upon formation of a sheet draw-in gap 35 lying before the image recording unit 29 as seen in the rotational sense 33 of the print roller 27, the sheet surface 34 approaches the underside of the print roller 27, whereby the sheet seating surface 34 is slanted in the direction toward the print roller 27. The sheet guidance surface 32 and the sheet seating surface 34 form a sheet guidance channel 36 open at both sides in whose end region a sheet conveying roller comprising a capstan idler 37 and formed by the sheet feeder roller 23 is arranged. The channel 36 continues in the form of a sheet discharge channel 38 following the sheet feeder roller 23 and the capstan idler 37. The sheet feeder roller or respectively sheet conveying roller 23 can be moved in the direction away from or respectively, toward the capstan idler 37 and thereby forms a shunt which enables an optional transfer of a recording sheet 25 coming from the channel 36 into the sheet discharge channel 38 or into an arc-shaped channel section 39 which allows a return of the recording sheet 25 to the print roller 27 for multiple printing of the same side of the recording sheet 25. The position of the paper conveying roller 23 required for this latter function of the inventive apparatus is drawn with solid lines, whereas the shunt position serving for transferring a recording sheet 25 into the sheet discharge channel 38 is shown with broken lines. The sheet deflection for both-sided printing of the recording sheet 25 in the exemplary embodiment shown in FIG. 7 ensues in the same way as in the exemplary embodiments previously set forth with reference to FIGS. 1 through 6. Due to the sheet conveying roller 23, however, the exemplary embodiment shown in FIG. 7 does not require a special shunt for outward transfer of a completely printed recording sheet into the sheet discharge channel 38. When, namely, the roller 23 is situated in the position shown with broken lines, a recording sheet 25 coming out of the sheet guidance channel 36 is introduced into the sheet discharge channel 38 (moving) past the sheet conveying roller 23 and the capstan idler 37. As soon as the sheet beginning of the recording sheet 25 coming from the channel 36 has proceeded into the sheet discharge channel 38, the sheet conveying roller 23 is pressed against the capstan idler 37 and is driven in the rotational sense referenced 40, so that the recording sheet 25 is completely conveyed into the sheet discharge channel 38. When, by contrast, the recording sheet is to be resupplied to the print roller 27 for the purpose of printing its backside, then the sheet conveying roller is situated in the position drawn with a solid line in which a recording sheet 25 coming from the channel 36 is deflected such that the sheet beginning of the recording sheet 25 proceeds into the arc-shaped channel section 39 until the sheet end of the recording sheet 25 falls down from the print roller 27 onto the sheet seating surface 34. By reversing the rotational sense of the sheet conveying roller 23 into the direction referenced 41, the recording sheet 25 now has its sheet end supplied to the print roller 27.

Figure 8:
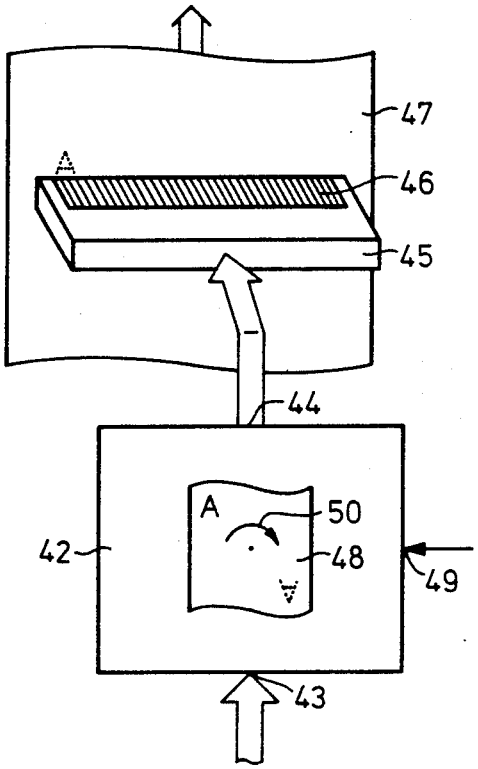

FIG. 8 shows a schematic illustration of a control structure for the exemplary embodiments of the inventive apparatus shown in FIGS. 1 through 7. The main component part of this control structure is a page storage means 42 to which the print information of an entire side is supplied via an input 43 and which outputs the print information to a recording head 45 via an output 44. The recording head 45 is fashioned as a lineshaped thermal-printing head which comprises a plurality of picture recording elements 46 arranged in a row for simultaneously printing an entire picture element line on a recording sheet 47. As already explained above, all information for a page to be printed is contained in the page storage means 42; the sheet of paper referenced 48 is intended to indicate this situation. The page storage means 42 comprises a control input 49, which, when charged by a signal, effects a 180° rotation of the memory contents of the page storage means 42; the arrow 50 is intended to illustrate this, this indicating that the rotation of the memory contents by 180° corresponds to the 180° rotation of a printed side. The assistance of the control structure shown in FIG. 8 makes it possible to print the backside of a recording sheet in the correct direction with reference to the front side thereof even though the recording sheet is supplied to the print roller and to the printing head in the wrong direction as a result of being reversed in the inventive apparatus.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. An apparatus for recording image information on both sides of a recording sheet, comprising:

a print roller;

an image recording unit operatively positioned adjacent said print roller, said print roller and recording unit forming sheet draw-in and discharge gaps;

a sheet guiding surface operatively positioned adjacent on underside of said print roller to feed a recording sheet between said print roller and said recording unit into said draw-in gap for recording of information on a first side of said sheet;

a sheet guidance surface operatively positioned above said print roller and operatively shaped to receive said recording sheet as it is discharged from said print roller and recording unit discharge gap;

a discharge surface operatively positioned adjacent said sheet guidance surface to selectively receive said recording sheet received by said sheet guidance surface;

a controllable shunt operatively positioned between said discharge surface and said sheet guidance surface to selectively permit said recording sheet to be discharged to said discharge surface;

a controller operatively coupled to said shunt; and a sheet acceptance surface operatively positioned adjacent an underside of said print roller between said print roller and said sheet guiding surface, said sheet acceptance surface selectively receiving said recording sheet when precluded from being discharged to said discharge surface by said controllable shunt such that said recording sheet so received is positioned for feeding into said draw-in gap for recording of information on a second side of said sheet.

2. An apparatus according to claim 1, wherein the sheet seating surface is slanted in the direction toward the print roller.

3. An apparatus according to claim 2, wherein the sheet seating surface and the sheet guidance surface form a sheet acceptance channel comprising a closed channel end at which the sheet seating surface and the sheet guidance surface abut against one another, the shortest distance between the closed channel end and the circumferential surface of the print roller is slightly smaller than the length of a recording sheet.

4. An apparatus according to claim 3, wherein a resilient detent is arranged in said channel end.

5. An apparatus according to claim 1, wherein the image recording unit comprises recording element arranged point-by-point in a line and has an output connected to an electronic page storage means which comprises a control input for turning the memory contents by 180°.

6. An apparatus according to claim 1, wherein said controllable shunt comprises a capstan idler and an opposed driveable sheet conveying roller, said sheet conveying roller being selectively engageable with said capstan idler.

* * * * *